US006536697B2

(12) United States Patent
Tsan

(10) Patent No.: US 6,536,697 B2
(45) Date of Patent: Mar. 25, 2003

(54) STRUCTURE OF AUTOMATIC SUSPENDER REELING DEVICE

(76) Inventor: Chin-Yuan Tsan, No. 99-35, Nan She Rd., Ching Shui Chen, Taichung (TW)

( * ) Notice: Subject to any disclaimer, the term of this patent is extended or adjusted under 35 U.S.C. 154(b) by 0 days.

(21) Appl. No.: 09/900,856

(22) Filed: Jul. 10, 2001

(65) Prior Publication Data

US 2003/0010861 A1 Jan. 16, 2003

(51) Int. Cl.[7] ..... B65H 75/48; B65H 75/30
(52) U.S. Cl. ..... 242/377; 242/385.3; 242/385.4
(58) Field of Search ..... 242/377, 385.3, 242/385.4; 224/162, 258

(56) References Cited

U.S. PATENT DOCUMENTS

| | | | | | |
|---|---|---|---|---|---|
| 939,971 | A | * | 11/1909 | Brennan | 242/385.4 |
| 2,769,475 | A | * | 11/1956 | Fisher | 242/385.4 |
| 3,176,931 | A | * | 4/1965 | Hannay | 242/377 |
| 3,343,764 | A | * | 9/1967 | Webb | 242/377 |
| 4,106,721 | A | * | 8/1978 | Ulrich | 242/377 |
| 4,340,192 | A | * | 7/1982 | Burris | 242/377 |
| 4,372,613 | A | * | 2/1983 | Kitakami et al. | 242/377 |
| 4,658,999 | A | * | 4/1987 | Hilty | 224/202 |
| 5,669,571 | A | * | 9/1997 | Graybill | 242/385.4 |
| 5,881,963 | A | * | 3/1999 | Hinkle | 242/385.4 |

* cited by examiner

*Primary Examiner*—John M. Jillions
(74) *Attorney, Agent, or Firm*—Bacon & Thomas, PLLC

(57) ABSTRACT

A structure of an automatic suspender reeling device, and especially a device in which an engaging member and a ratchet wheel are mutually engaged with or separated from each other to control pulling out or retracting of a wound suspender. The reeling device includes a receiving box, a cover, a ratchet wheel and an engaging member. The receiving box has a receiving space therein. One side of the receiving space is an opened side to place in the ratchet wheel and the engaging member. An engaging portion on the bottom of the engaging member engages the teeth of the ratchet wheel. A suspender is wound onto the ratchet wheel. One end of the suspender extends through a through hole on the engaging member and out of the receiving box, after which, a cover is put on the opened side of the receiving space to complete the reeling device.

3 Claims, 6 Drawing Sheets

STRUCTURE OF AUTOMATIC SUSPENDER REELING DEVICE

BACKGROUND OF THE INVENTION

1. Field of the Invention

The present invention is related to an automatic suspender reeling device, and especially to such a device in which an engaging member and a ratchet wheel are mutually engaged with or separated from each other to control pulling out or retracting of a wound suspender, such that adjustment of the length of extension of the suspender is obtained. A backpack or a handbag is provided on both lateral sides thereof with such a reeling device, and by operation of the free winding of the reeling device for adjustment in order to get a suitable length of the suspender, the suspender can be extended for shouldering, or shortened for hand carrying, and the backpack or the handbag can thus be carried easily.

2. Description of the Prior Art

Various carrying tools such as bags, packs etc. sold in the markets are provided with suspenders for shouldering by users; in use, the suspenders have to be adjusted to get suitable lengths to attain desired factors that involve sizes of the users or the bags or packs to suit shouldering by the users in a convenient way. Suspenders used on various bags or packs are all controlled by engagement of buckles each in the shape of "–̂", such a "–̂" shaped buckle "A" (as shown in FIGS. 1 and 1A) has a middle rod "B" is connected with one end of a suspender 10, the other end of the suspender 10 is extended through a ring "C" of a bag, and then through the "–̂" shaped buckle "A". The aforesaid other end of the suspender 10 is fixedly connected to another ring "C". In this arrangement, when the length of the suspender 10 is adjusted, the parts of the suspender 10 on the left and the right sides of the "–̂" shaped buckle "A" must be pulled to displace the "–̂" shaped buckle "A" on the suspender 10, and the length of the suspender 10 can be adjusted. Such mode of adjustment is difficult and some problems are listed as follows:

1. The "–̂" shaped buckle "A" is directly provided on the suspender 10, and by pulling of the suspender 10, the "–̂" shaped buckle "A" is tightly sustained on the suspender 10, such that displacement or adjustment of the "–̂" shaped buckle "A" is quite difficult.
2. When the suspender 10 is extended through the "–̂" shaped buckle "A", it is often torn by the hooking of the "–̂"shaped buckle "A", such that, the area to be adjusted always causes the tearing off of threads, and breakage of the suspender 10 may occur. And when the suspender 10 is not used temporarily, it can not be withdrawn for storage, but can only be randomly placed on the bag, hence the suspender 10 may become attached to some external item or be tangled on one's body, accidents may occur.

The above stated problems created in using the prior art suspender makes bags inconvenient for carrying, and improvement is warranted.

SUMMARY OF THE INVENTION

The main object of the present invention is to establish the structure of the automatic reeling device by extending a suspender through an engaging member and then fixing it on a ratchet wheel, and by mounting the engaging member and the ratchet wheel together in a box. The reeling device can now be installed on any bag to adjust the length of extension of the suspender quickly and conveniently.

The secondary object of the present invention is to provide an engaging portion on the bottom of the engaging member in the reeling device for engaging with the teeth of the ratchet wheel. By engaging the engaging member with the ratchet wheel, the suspender can extend through the engaging member to be pulled out or retracted.

Another object of the present invention is to make the engaging member of the reeling device movable upwardly to render the engaging portion on the bottom of the engaging member to move away from the teeth of the ratchet wheel so that a helix spring in the ratchet wheel winds back to reel the suspender back onto the ratchet wheel.

A further object of the present invention is to provide a recess on the engaging member, and to provide a protrusion on the reeling device corresponding to the recess. By engaging the protrusion in the recess, the effect of fixing the engaging member on the reeling device can be enhanced, and the engaging member is not subjected to being swayed or displaced.

The present invention will be apparent after reading the detailed description of the preferred embodiments in reference to the accompanying drawings.

DETAILED DESCRIPTION OF THE PREFERRED EMBODIMENT

Figure 1:
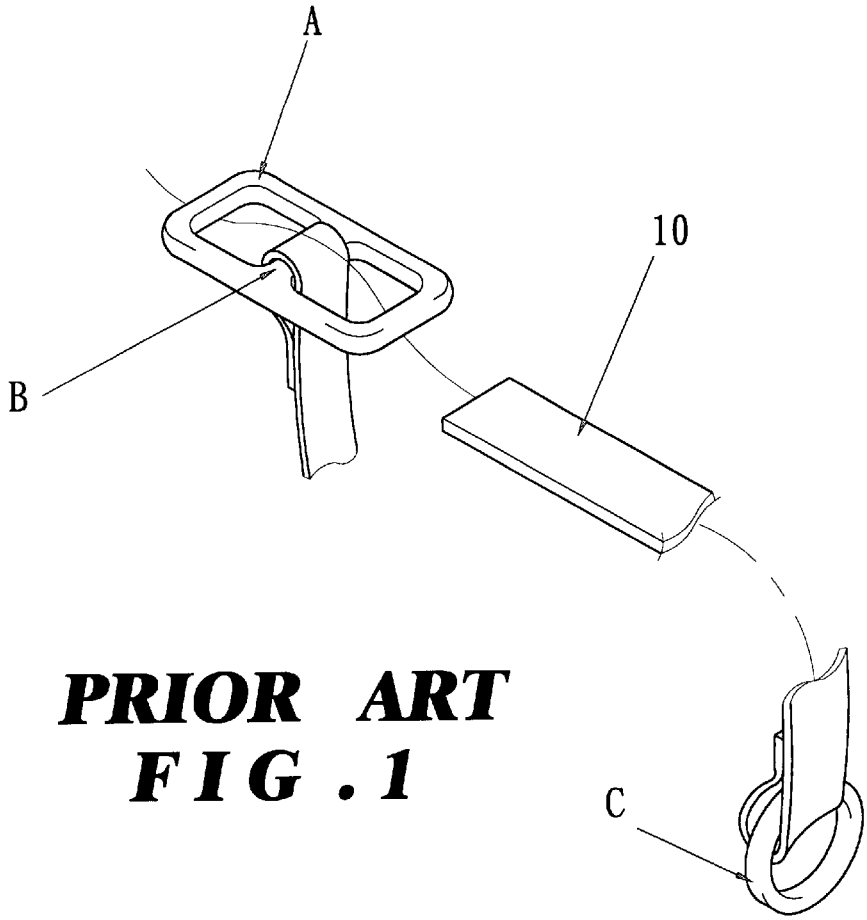
PRIOR ART FIG. 1
FIG. 1 is a schematic perspective view of the structure of a conventional "–̂" shaped buckle.
Figure 1A:
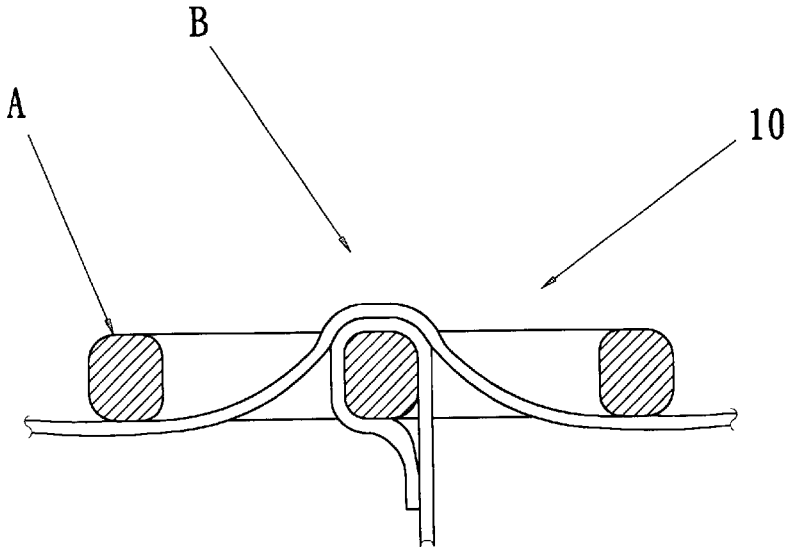
PRIOR ART FIG. 1A
FIG. 1A is a sectional view of the structure of the conventional "–̂" shaped buckle.
Figure 2:
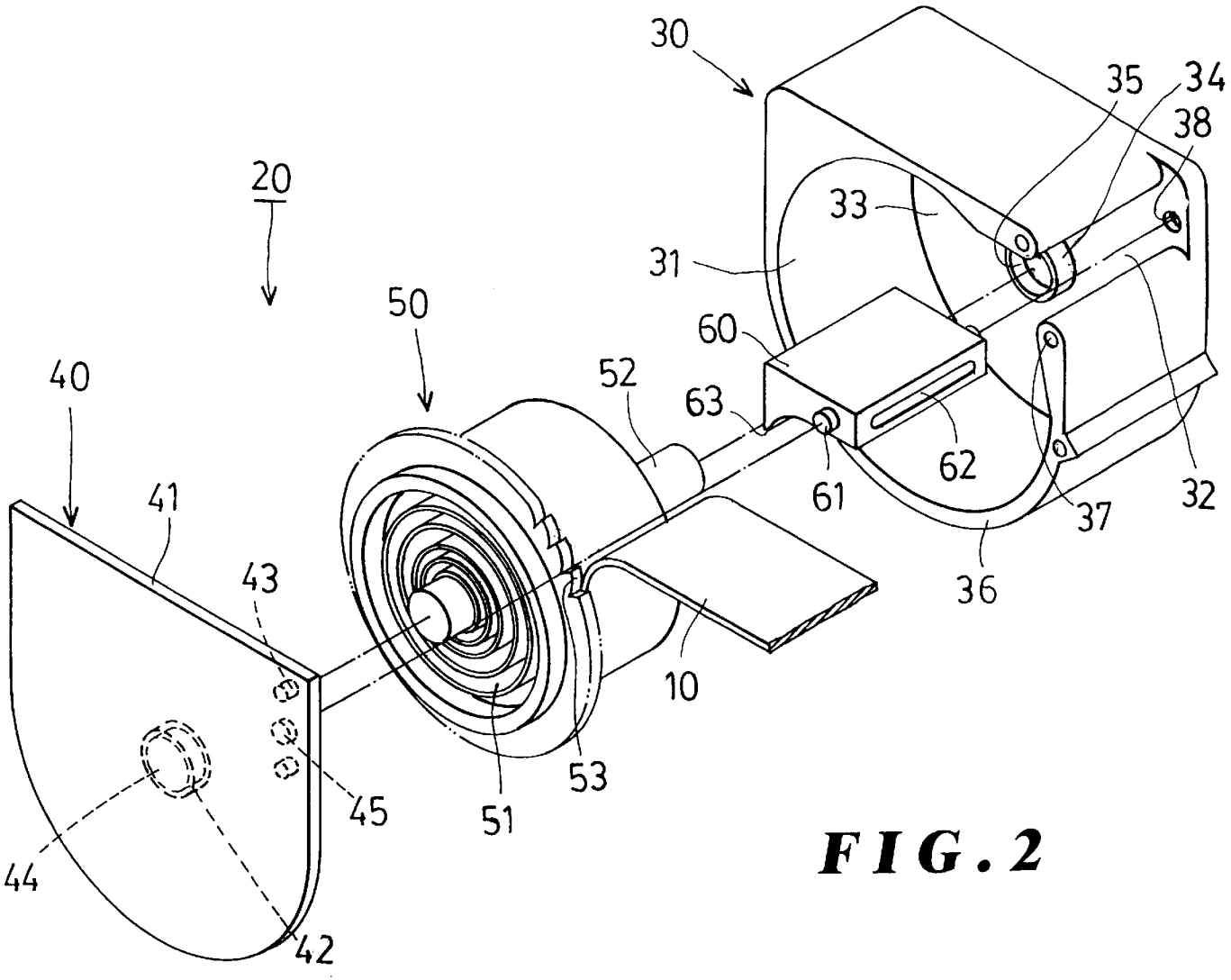
FIG. 2 is an analytic perspective view of the structure of the present invention.
Figure 3:
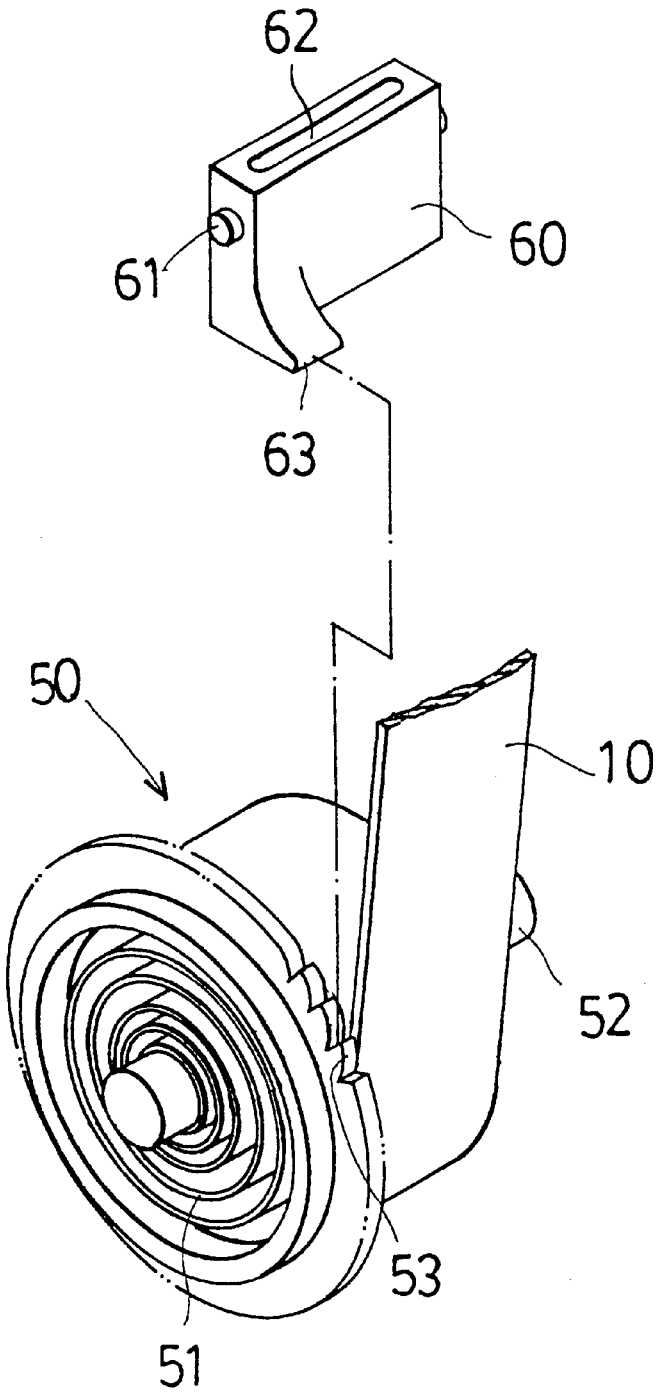
FIG. 3 is an analytic perspective view showing the structure of the engaging member and a ratchet wheel of the present invention.
Figure 4:
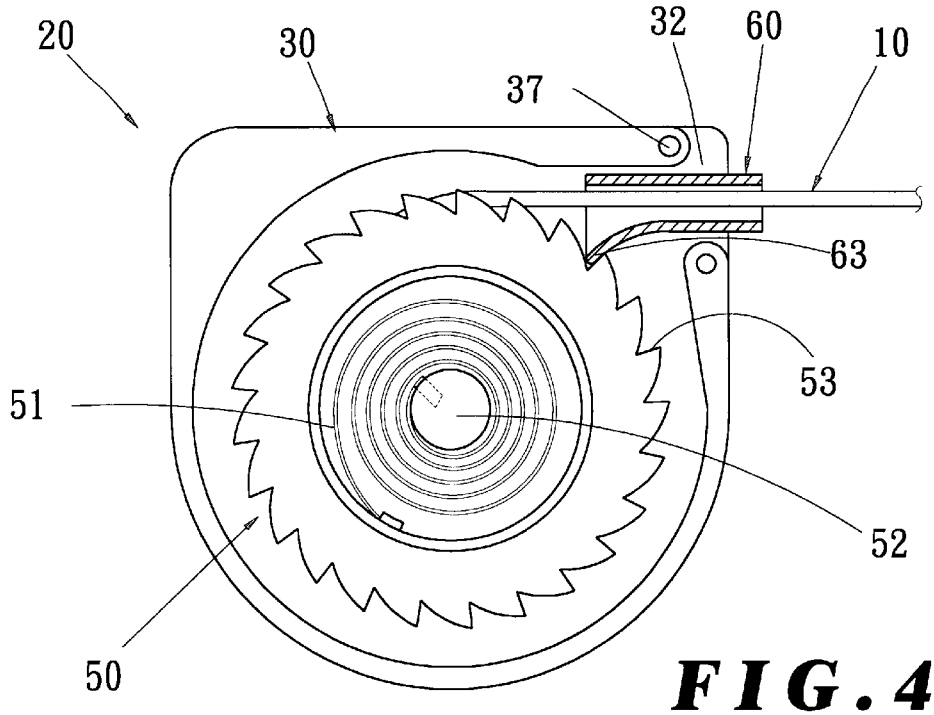
FIG. 4 is a sectional view of the structure of the present invention.

Referring to FIGS. 2, 3 and 4, the reeling device 20 for the suspender 10 of the present invention is comprised of a receiving box 30, a cover 40, a ratchet wheel 50 and an engaging member 60.

The receiving box 30 has a receiving space 31 therein; a slit 32 is positioned on a lateral upper end of the receiving space 31 and is provided at an end thereof with an engaging hole 38. An inner wall 33 in the receiving space 31 is provided with a pivotally connecting annulus 34 with a pivotally connecting hole 35 therein, and at the opposite side of the inner wall 33 there is an opened side 36 with a plurality of securing holes 37 on the peripheral rim thereof.

The cover 40 covers the opened side 36 of the receiving box 30, and is provided on the inner surface 41 thereof with an engaging hole 45, a pivotally connecting stub 42 and a plurality of engaging protrusions 43. The pivotally connection stub 42 had therein a pivotally connecting round hole 44. And by engagement of the engaging protrusions 43 into the securing holes 37 on the opened side 36, the cover 40 can cover the opened side 36.

The ratchet wheel 50 is provided therein with a helical or helix spring 51 and a central wheel axle 52, and the ratchet wheel 50 is mounted in the receiving space 31 of the receiving box 30. One end of the wheel axle 52 is embedded in the pivotally connecting hole 35 of the pivotally connecting annulus 34 on the inner wall 33 of the receiving space 31. The other end of the wheel axle 52 is engaged into the pivotally connecting round hole 44 on the pivotally connecting stub 42 of the cover 40, so that the ratchet wheel 50 can rotate in the receiving space 31. The ratchet wheel 50 is provided on the upper portion thereof with teeth 53, and the suspender 10 is wound onto the wheel axle 52.

The engaging member 60 is pivotally provided at the slit 32 on a lateral upper end of the receiving space 31 of the receiving box 30, and is provided on both ends thereof with an engaging stub 61 respectively engaged into the engaging hole 38 on one side of the slit 32 and into the engaging hole 45 of the cover 40. The engaging member 60 is provided with a through hole 62 for extension of the suspender 10 on the ratchet wheel 50 therethrough, and is provided on the bottom of one side thereof with an engaging portion 63 for engaging with the teeth 53 of the ratchet wheel 50.

Figure 5:
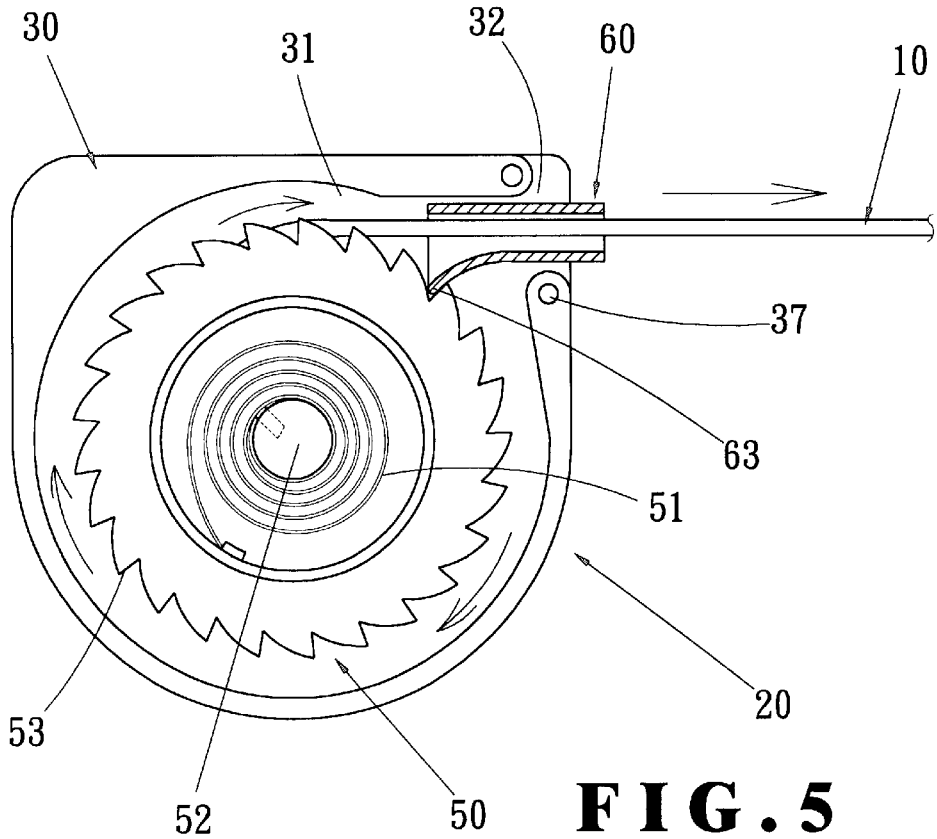
FIG. 5 is a schematic view showing a suspender of the present invention that is pulled outwardly.

By composing the reeling device 20 from the abovementioned members, the ratchet wheel 50 and the engaging member 60 are in combination, pivotally mounted in the receiving space 31 of the receiving box 30. The engaging portion 63 of the engaging member 60 engages the teeth 53 of the ratchet wheel 50. After the suspender 10 that is wound on the ratchet wheel 50 is extended through the through hole 62 of the engaging member 60, it can be pulled out of the box 30. When pulling the suspender 10, the ratchet wheel 50 is rotated thereby, and the teeth 53 of the ratchet wheel 50 are swiveled accordingly without being hindered by the engaging portion 63 of the engaging member 60 (as shown in FIG. 5), such that the suspender 10 can be pulled smoothly out to a desired length.

Figure 6:
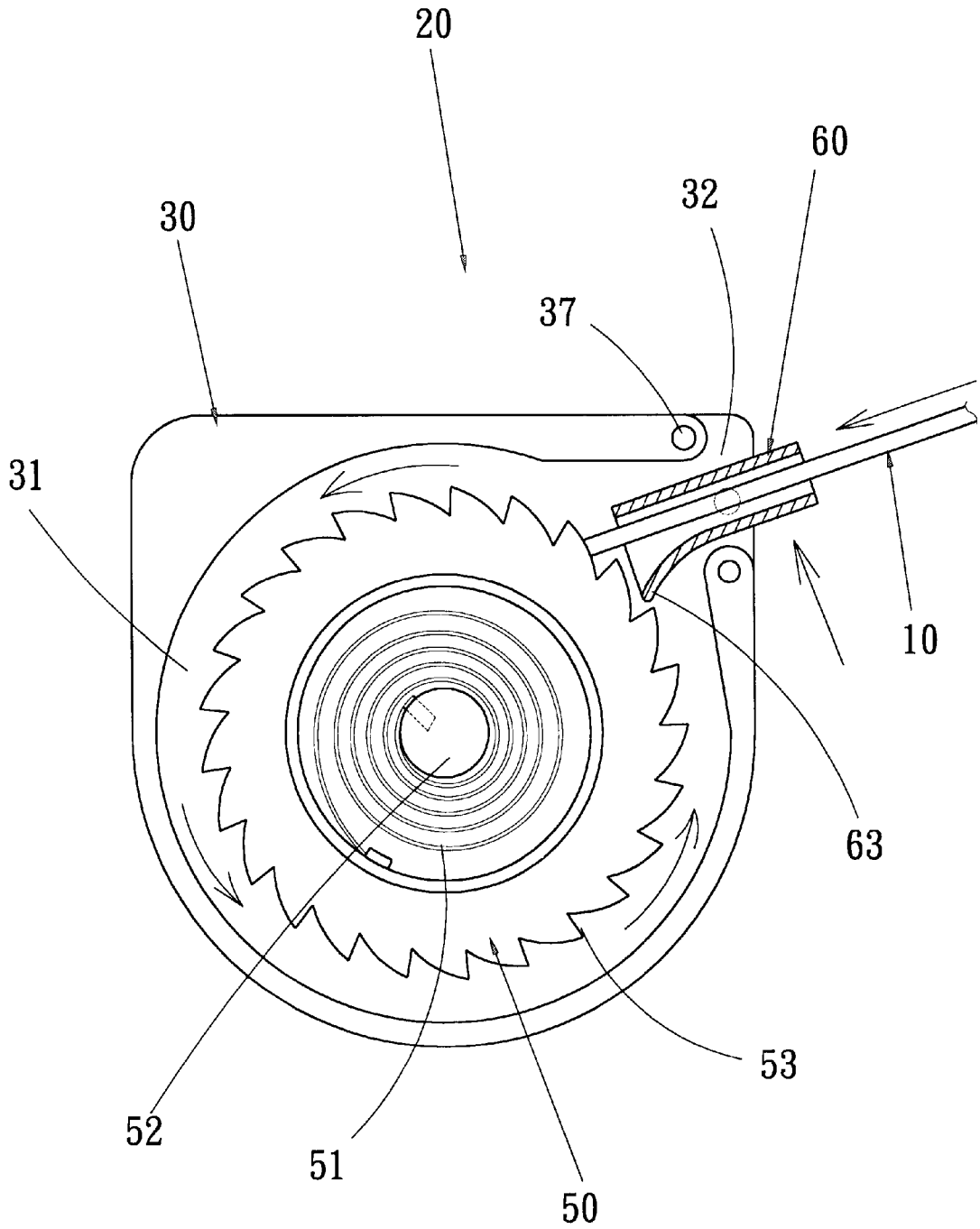
FIG. 6 is a schematic view showing the suspender of the present invention that is wound back.

Referring to FIG. 6, when retracting the suspender 10, the engaging member 60 of the reeling device 20 shall be raised or tilted upwards, and the engaging portion 63 of the engaging member 60 will push the teeth 53 being engaged therewith and will be tilted downwardly to disengage the teeth 53. After which, the ratchet wheel 50 is no longer restrained, and the force of the helix spring 51 rotates the ratchet wheel 50 in the counter direction to reel the suspender 10 back onto the ratchet wheel 50, so that the suspender 10 is reeled quickly into the box 30. The reeling device 20 reels back the suspender 10, and the engaging member 60 is raised, and when the suspender 10 is reeled to a suitable length, the engaging member 60 is pushed back to its original position to engage the engaging portion 63 of the engaging member 60 with the teeth 53 of the ratchet wheel 50 (as shown in FIG. 5), upon which, the suspender 10 will not be retracted into the reeling device 20 even if the ratchet wheel 50 stops rotating, and desired positioning of the suspender 10 can be obtained.

Figure 7:
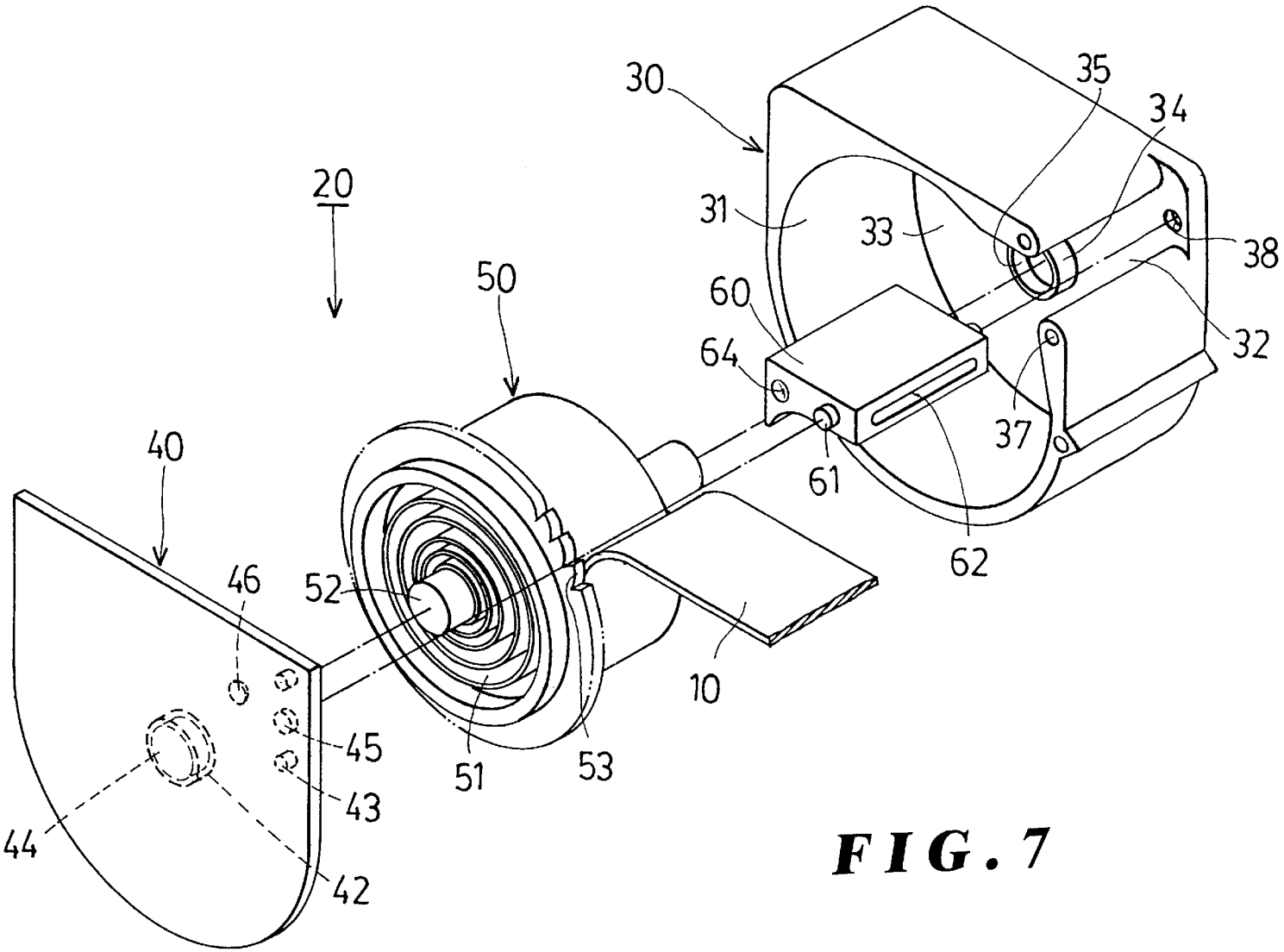
FIG. 7 is an analytic perspective view showing another preferred embodiment of the present invention.

Referring to FIG. 7, the reeling device 20 of the present invention is provided on a lateral side of the engaging member 60 with a recess 64, while the cover 40 is provided with a protrusion 46 corresponding to the recess 64. By engaging the protrusion 46 of the cover 40 in the recess 64 of the engaging member 60, the engaging member 60 is fixed and is not subjected to being swayed or displaced by a small force. However, when the suspender 10 is pulled out of or retraced into the reeling device 20, a mild force is adequate to move the engaging member 60 to separate the protrusion 46 from the recess 64 temporarily.

Accordingly, the present invention has the ratchet wheel and the engaging member provided in the reeling device allows the suspender to be pulled out or reeled in to adjust the length of the suspender quickly and easily, and the bag can be shouldered on a user's shoulder once the suspender is adjusted to a suitable length.

Having thus described my invention, what I claim as new and desire to be secured by Letters Patent of the United States are:

1. A structure of an automatic suspender reeling device, said structure comprises a receiving box, a cover, a ratchet wheel and an engaging member, wherein:

said receiving box has a receiving space therein, a slit is left on a lateral upper end of said receiving space;

an inner wall in said receiving space is provided with a pivotally connecting hole, the opposite side of said inner wall is an opened side;

said cover covers said opened side of said receiving box;

said ratchet wheel is mounted in said receiving space of said receiving box to be rotatable in said receiving space, and is provided therein with a helix spring and a wheel axle at the center thereof, a suspender is wound on said wheel axle;

said engaging member is pivotally provided at said slit on said lateral upper end of said receiving space of said receiving box, and is provided therein with a through hole for extension of said suspender on said ratchet wheel therethrough, and is provided on the bottom of one side thereof with an engaging portion for engaging with teeth of said ratchet wheel;

said ratchet wheel and said engaging member are together pivotally mounted in said receiving space of said receiving box, said engaging portion of said engaging member engages said teeth of said ratchet wheel; and after said suspender wound on said ratchet wheel is extended through said through hole of said engaging member, said suspender is pulled out of said receiving box, and during pulling of said suspender, said ratchet wheel is rotated thereby, said teeth of said ratchet wheel are swiveled accordingly without hindering by said engaging portion of said engaging member, and said suspender is pulled out for a suitable length smoothly.

2. The structure of an automatic suspender reeling device as in claim 1, wherein said reeling device is provided on a lateral side of said engaging member with a recess, while said cover is provided with a protrusion corresponding to said recess; by engaging of said protrusion of said cover in said recess of said engaging member, said engaging member is fixed and is not subjected to swaying or displacement by a small force; and when said suspender is pulled out of or retracted into said reeling device, a mild force is adequate to move said engaging member to separate said protrusion from said recess temporarily.

3. The structure of an automatic suspender reeling device as in claim 1, wherein, said helix spring provided in said ratchet wheel is connected on one end thereof to the inner wall of said ratchet wheel, and connected on the other end thereof fixedly to said wheel axle at the center of said ratchet wheel; when said suspender wound on said wheel axle is pulled, said wheel axle is rotated to wind said helix spring, and engagement of said engaging portion on said engaging member with said teeth of said ratchet wheel makes said ratchet wheel restrained from moving; on removing of said engaging portion on said engaging member from said teeth of said ratchet wheel, said helix spring in said ratchet wheel is released to wind in a contrary direction to rotate said wheel axle, thereby said suspender is reeled back onto said wheel axle.

* * * * *